US010596407B1

(12) United States Patent
Maresh et al.

(10) Patent No.: US 10,596,407 B1
(45) Date of Patent: Mar. 24, 2020

(54) STEPPER EXERCISE APPARATUS

(71) Applicants: Joseph D Maresh, West Linn, OR (US); Kenneth W Stearns, Houston, TX (US)

(72) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 4 days.

(21) Appl. No.: 15/709,429

(22) Filed: Sep. 19, 2017

Related U.S. Application Data

(63) Continuation-in-part of application No. 15/691,737, filed on Aug. 30, 2017, now abandoned.

(60) Provisional application No. 62/495,662, filed on Sep. 19, 2016.

(51) Int. Cl.
*A63B 22/00* (2006.01)

(52) U.S. Cl.
CPC ..... *A63B 22/0056* (2013.01); *A63B 22/0025* (2015.10); *A63B 2022/0038* (2013.01)

(58) Field of Classification Search
CPC . A63B 22/0058; A63B 22/04; A63B 23/0458; A63B 22/00–0694; A63B 22/0056–0069; A63B 22/0664; A63B 2022/067–0688
See application file for complete search history.

(56) References Cited

U.S. PATENT DOCUMENTS

| | | | | |
|---|---|---|---|---|
| 5,997,445 | A * | 12/1999 | Maresh | A63B 22/001 482/51 |
| 6,135,923 | A * | 10/2000 | Stearns | A63B 22/001 482/51 |
| 6,572,514 | B1 * | 6/2003 | Calafato | A63B 22/0056 482/79 |
| 7,513,854 | B1 * | 4/2009 | Stearns | A63B 22/001 482/52 |
| 7,955,225 | B1 | 6/2011 | James | |
| 8,636,627 | B2 * | 1/2014 | Zhang | A61B 5/1124 482/52 |
| 9,199,115 | B2 * | 12/2015 | Yim | A63B 22/001 |
| 2007/0219061 | A1 | 9/2007 | Rodgers, Jr. | |
| 2009/0093346 | A1 * | 4/2009 | Nelson | A63B 22/001 482/52 |
| 2010/0248899 | A1 * | 9/2010 | Bedell | A63B 22/001 482/4 |
| 2011/0082009 | A1 * | 4/2011 | Ranky | A63B 22/0605 482/8 |
| 2012/0172176 | A1 * | 7/2012 | Zhang | A63B 71/0054 482/8 |
| 2013/0091983 | A1 * | 4/2013 | Scheiman | B62M 3/08 74/594.6 |

* cited by examiner

*Primary Examiner* — Nyca T Nguyen
(74) *Attorney, Agent, or Firm* — Nick A Nichols, Jr.

(57) ABSTRACT

An exercise apparatus may include a frame configured to rest on a floor surface. Left and right foot members may be mounted on respective sides of a stanchion connected to the frame. The foot members may include foot platforms securely fixed to a lower distal end thereof. Toe plates may be pivotally secured to the foot platforms. The toe plates may be rotatable for engagement with a trigger switch operative connected to a display.

4 Claims, 11 Drawing Sheets

200
227
140
236
230
232
234
138
232
140
230
234
112

300
140
326
327
31
314
30
312
314
310
114
140
112

400
474
474
472
455
459
420
150
450
433
440
450
470
436
430
431
432
433
412
432
410
448
449

500

505
583
580
581

550
520
550
550
540
590
599

600
150
128
122
127
689
688
680
685
682
682
687
690
695
654
132
654
654
640
655
675
621
638
114
638
130
640
636
649
650
112
110

600
122
695
689
685
680
682
136
638
688
681
680
655
675
640
649
650
130
112
640

STEPPER EXERCISE APPARATUS

CROSS-REFERENCE TO RELATED APPLICATION

This application claims the benefit of U.S. Provisional Application Ser. No. 62/495,662, filed Sep. 19, 2016, and is a continuation-in-part of U.S. patent application Ser. No. 15/691,737, filed Aug. 30, 2017, which applications are herein incorporated by reference in their entirety.

BACKGROUND

The present invention relates to stationary fitness equipment, more particularly, to exercise apparatus which encourage and train a user to alternately apply the full force of the user's body weight on a downwardly moving foot platform while simultaneously removing the load on the opposite upwardly moving foot platform.

Typically, prior art dependent climber and stepper exercise apparatus, use a dependent mechanism inherent with a given stepper/climber design in a manner which results in minimal calorie burn. In this respect, the lower calorie burn occurs while the user is essentially balancing his weight between the right and left foot platforms through the dependent mechanism. The dependent mechanism may, for example, include a cable connecting right and left foot platforms, and where the cable is routed over a central top pulley. In another example, the foot members may be driven by a crank such that as a left foot platform moves down, the opposite side diametrically opposite crank, moves the right foot platform upward. In both examples, the user's weight is generally balanced between the right and left foot platforms so that each of the user's legs only bears one half of the weight of the user while exercising.

Generally, the primary variables for increasing the intensity of a workout using prior art dependent climber and stepper exercise apparatus, are to either increase speed or increase resistance (disregarding adjustment of inclination). This is because with a dependent stepper/climber exercise apparatus, the user is more directly coupled to the resistance system. However, it should be noted that if the user simply balances the right and left feet against the foot platforms during operation of the exercise apparatus, then any associated display indicating calorie burn rate must be calibrated to account for this balancing expectation or the data displayed will be erroneous.

Conversely, with an independent stepper/climber, a decrease of resistance results in an increase in calorie burn because the user is forced to exercise more rapidly therefore performing a more aerobic workout. With an independent stepper/climber, the right and left sides are isolated, and an increase in downward resistance of an independent stepper/climber will simply result in a slow, and somewhat easy descent of the foot platform(s).

SUMMARY

An exercise apparatus may include a frame configured to rest on a floor surface. Left and right foot members may be mounted on respective sides of a stanchion connected to the frame. The foot members may include foot platforms securely fixed to a lower distal end thereof. Toe plates may be pivotally secured to the foot platforms. The toe plates may be rotatable for engagement with a trigger switch operative connected to a display.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
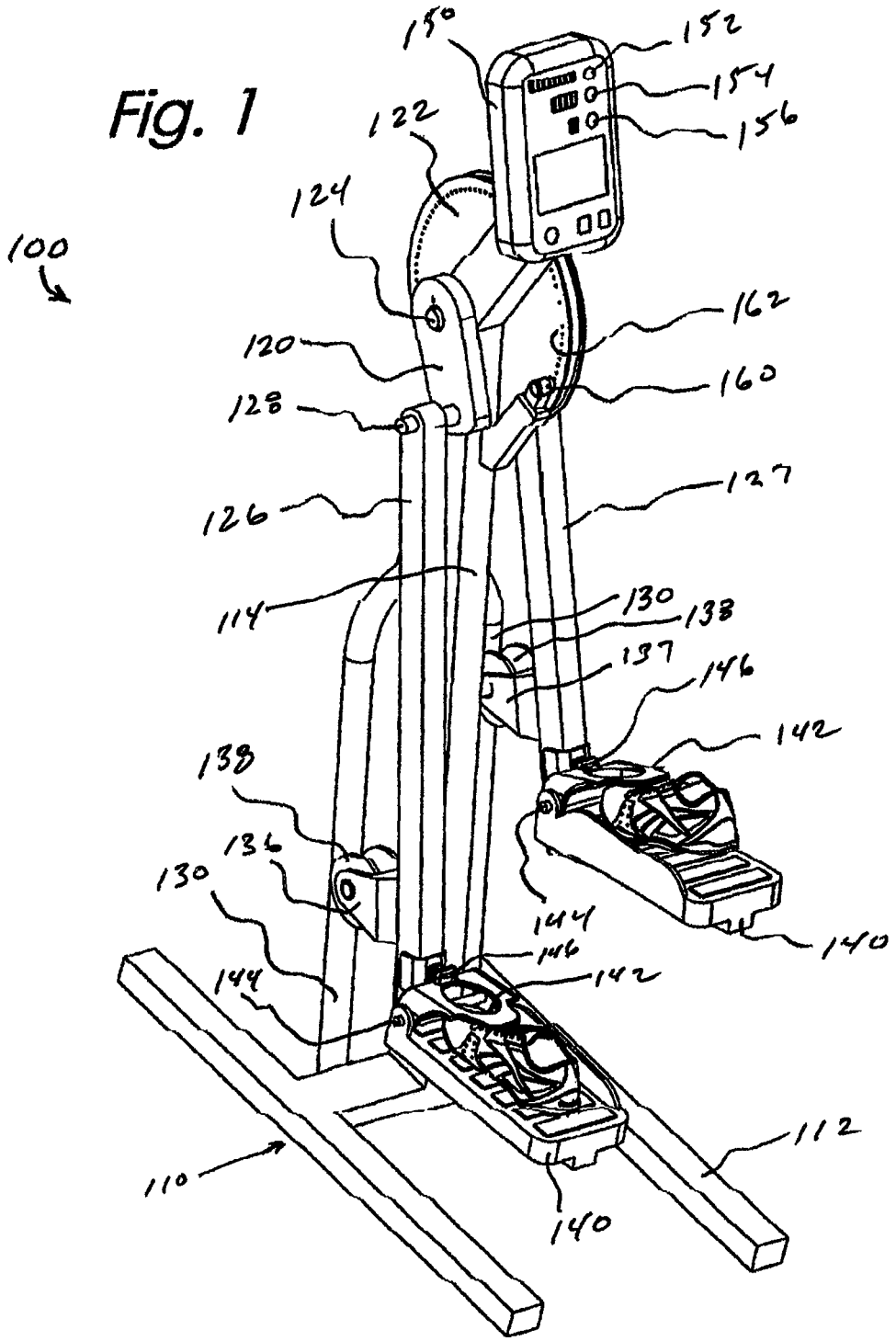
FIG. 1 is a perspective view of an exercise apparatus.

Referring first to FIG. 1, an exercise apparatus in generally identified by the reference numeral 100. The exercise apparatus 100 may include a frame 110 configured to rest on a substantially flat surface, such as but without limitation, a floor surface. The frame 110 may include a base 112 and a stanchion 114 extending upwardly from the base 112.

A left crank 120 and a right crank 122 may be rotatably secured to opposite sides of the stanchion 114 at crank shaft 124. The left crank 120 and right crank 122 may be keyed to the crank shaft 124 so that they rotate together. The right crank 122 is depicted as a disc for illustrative purposes. It may be recognized by those skilled in the art that either or both of the cranks may be in the form of discs as shown in FIGS. 7-11.

The exercise apparatus 100 may include a stationary handlebar (not shown in the drawings) for grasping by an operator while exercising. It may be noted that a stationary handlebar may be replaced with handlebars which move under resistance, for exercising a user's upper body. Such handlebars may, for example, pivot about an axis transverse to the longitudinal axis of the stanchion 114 and may include hand grips located at a comfortable position for grasping by a user. It will be recognized by those skilled in the art that various designs of handlebars, poles, cranks, levers and the like may be incorporated in the design of the exercise apparatus 100.

A left foot member 126 may be rotatably connected to the crank 120 at pivot shaft 128. A right foot member 127 may be rotatably connected to the crank 122 at a pivot shaft 128.

Figure 2:
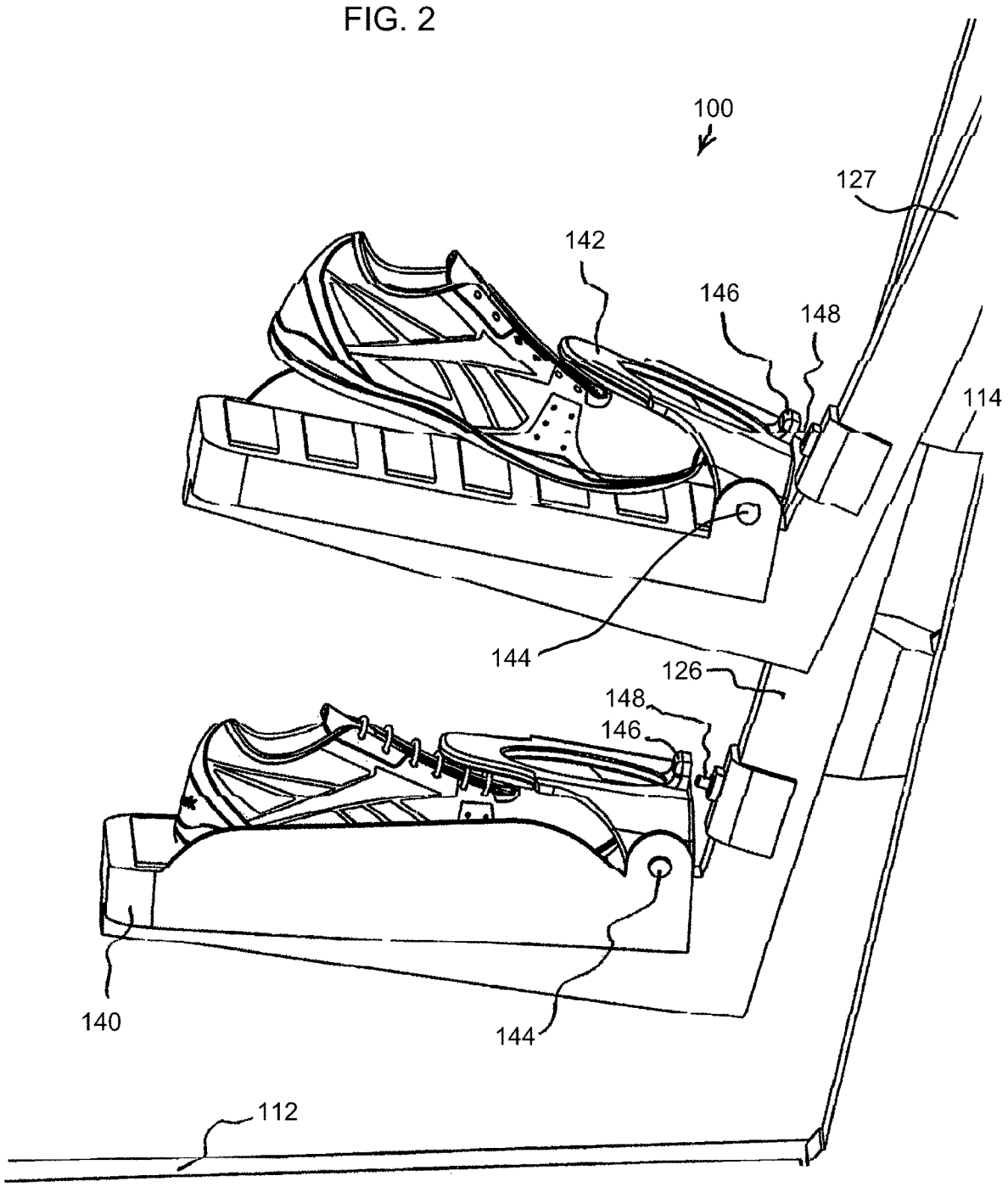
FIG. 2 is a partial fragmented perspective view of the exercise apparatus shown in FIG. 1.

Although only one side of the linkage configuration of the exercise apparatus 100 is fully shown in FIGS. 1 and 2, those skilled in the art will recognize that opposite side counterparts are arranged to be approximately one hundred and eighty degrees out of phase relative to the parts shown.

Left and right frame members 130 may extend generally vertically from the base 112. The upper distal ends of the frame members 130 may connect to the stanchion 114 at 111 at a lobe 132 located at an intermediate point between the distal ends of the stanchion 114 (shown in FIG. 3). The frame members 130 may be spaced apart and located on either side of the stanchion 114 and may define a generally vertical plane substantially parallel to the longitudinal axis of the stanchion 114.

Referring still to FIG. 1, roller brackets 136, 137 may secure rollers 138 to intermediate regions of the left and right foot members 126, 127, respectively. The rollers 138 may be in rolling contact with respective frame members 130. During operation of the exercise apparatus 100, the rollers 138 may roll along the frame members 130 during the up and down movement of the foot platforms 140.

Foot platforms 140 may be sized and configured to support a user's foot and may be integrally formed with or rigidly secured to respective left and right foot members 126, 127. Toe plates 142 may be rotatably connected to respective foot platforms 140 at pivot shaft 144. The toe plates 142 may include a striker plate or boss 146 at a front face of the toe plates 142. A trigger switch 148 may be fixedly secured proximate the lower distal ends of the left and right foot members 126, 127. The striker boss 146 and trigger switch 148 may be in a spaced facing relationship to one another defining a gap therebetween. The trigger switch 148 may be normally closed.

A high calorie burn may be achieved by a user properly operating the exercise apparatus. To this end, the exercise apparatus 100 may include a display 150 mounted to the stanchion 114. The display 150 may include visual/audio indicators that provide real time feedback to the user while exercising. For example, but without limitation, the display 150 may include lights 152, 154 and 156. Illumination of the light 152 may indicate that the user is properly performing the exercise. That is, maximum calorie burn occurs when the user lifts his foot off a foot platform 140 during upward movement of the foot platform 140. This action transfers the user's body weight to his opposite leg, thereby applying maximum downward force on the downward moving foot platform 140. Illumination of the light 152 may thus indicate to the user that he is properly lifting his foot during the up stroke of the exercise so that no downward force is applied on the upward traveling foot platform 140.

Lifting of the user's foot engages the toe plate 142 and pivots it about the pivot shaft 144 so that the striker boss 146 contacts the trigger switch 148 to complete an electronic circuit connecting the visual/audio indicators. For the embodiment of the exercise apparatus 100 shown in FIG. 1, actuation of the trigger switch 148 causes one of the lights 152, 154, 156 to illuminate. In the event the user fails to properly lift his foot off an upward moving foot platform 140, display light 156, for example but without limitation, may illuminate indicating to the user that he failed to properly lift his foot. Conversely, the exercise apparatus 100 may be designed to indicate minimum calorie burn by configuring none of the display lights to illuminate when the user has failed to open the trigger switch 148. Illumination of the display light 154 may be configured, for example but without limitation, to indicate a partial effort. That is, the user failed to hold the foot lift during the entire up stroke of the foot platform 140.

Illumination of the display lights 152, 154, 156 may be facilitated by mounting a sensor 160 proximate the crank 122 that may read targets 162 on the crank 122. Since the orientation of the crank 120 and crank 122 is known, the control panel 150 may be programed to disregard periods when the user may be pushing down while a foot platform 140 is moving downward against resistance. An unsymmetrical pattern of targets 162 may provide meaningful video/audio prompts regardless of the rotation direction the cranks 120, 122. Video/audio indicators may include, but not limited to, audible prompts by words or tones, or by vibrations induced at each foot platform 140 and the like.

Figure 3:
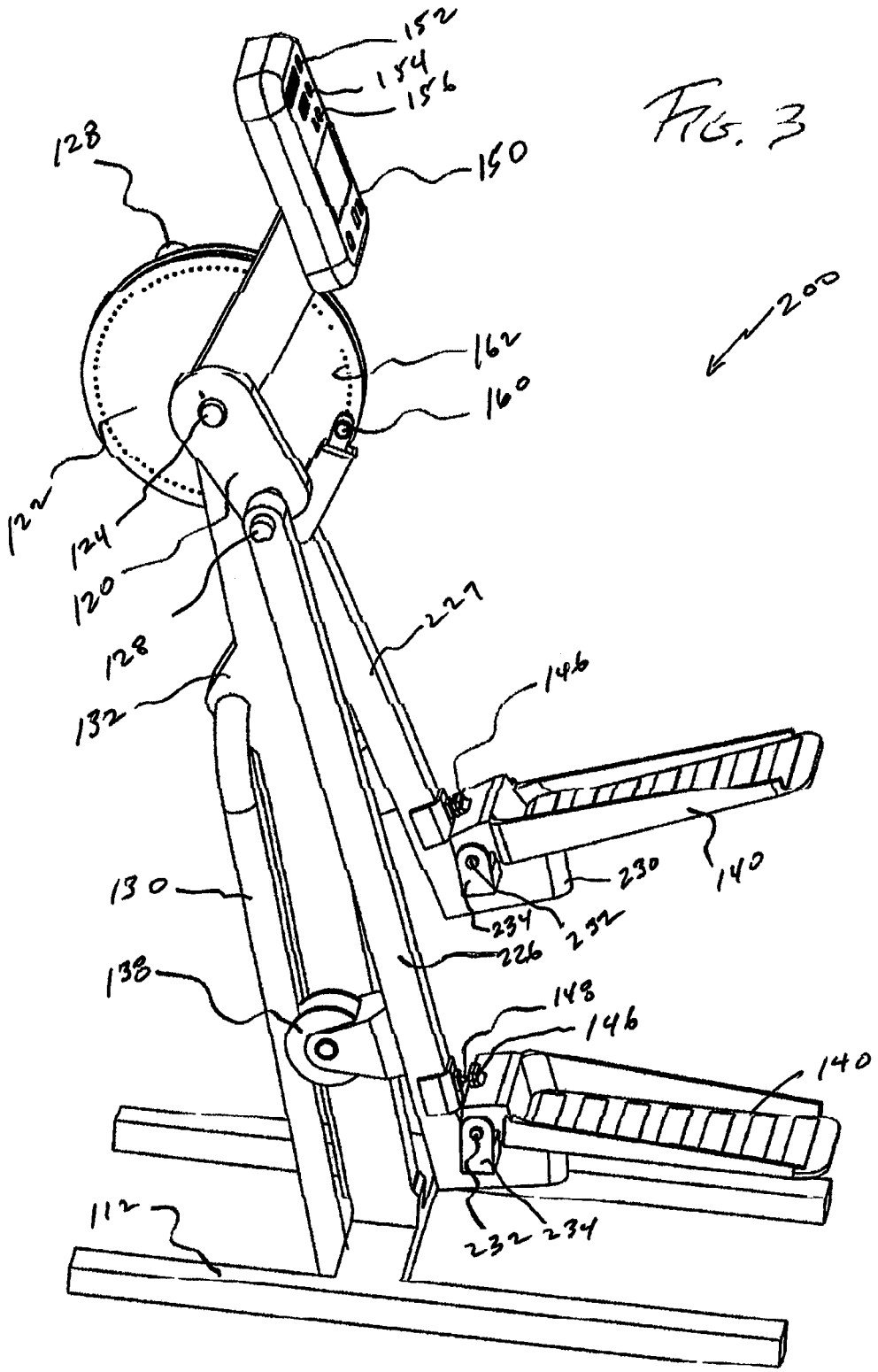
FIG. 3 is a perspective of a second embodiment of an exercise apparatus.
Figure 4:
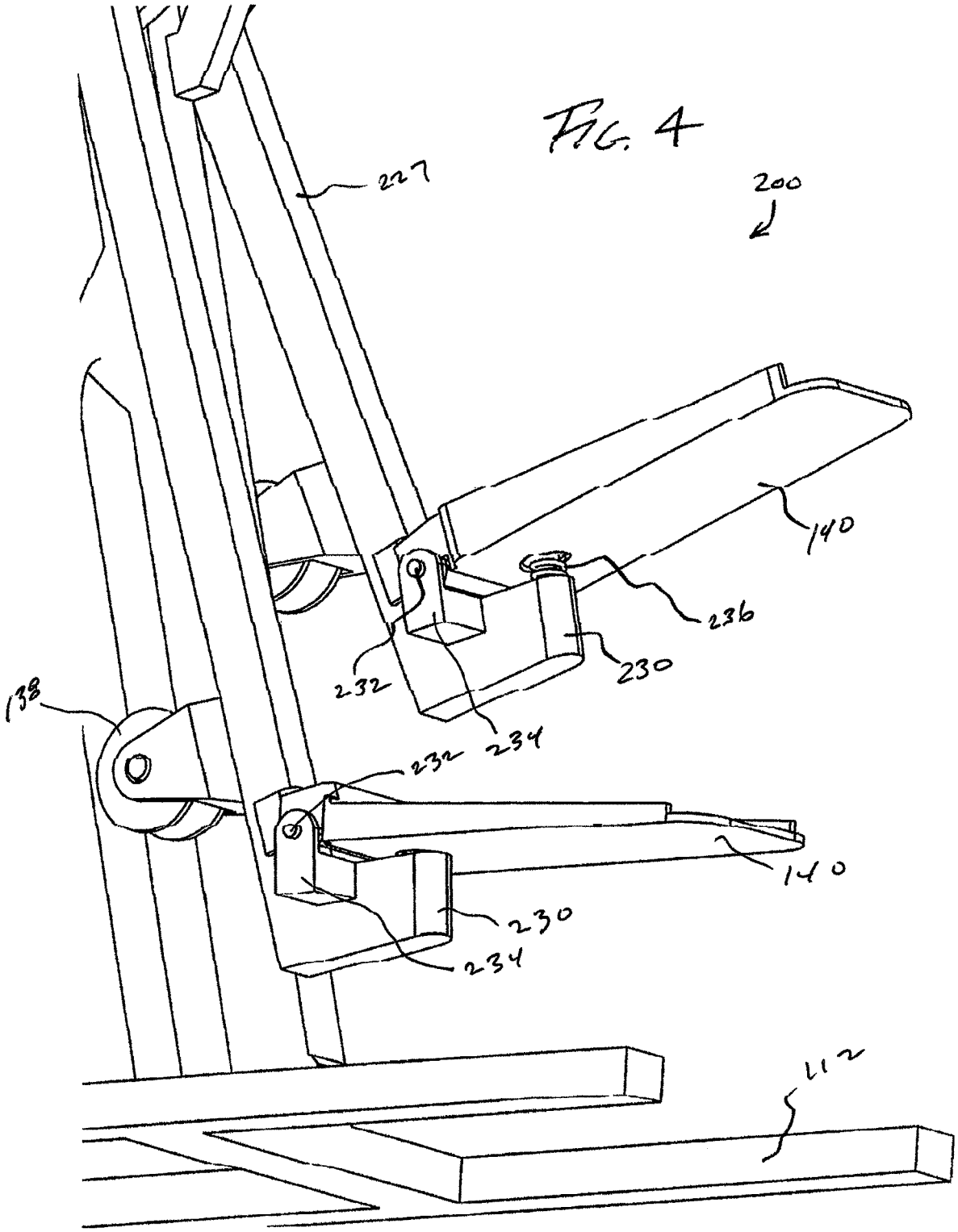
FIG. 4 is a partial fragmented perspective view of the exercise apparatus shown in FIG. 3.

Referring now to FIGS. 3 and 4, a second embodiment of an exercise apparatus is generally identified by the reference numeral 200. As noted by the use of common reference numerals, the exercise apparatus 200 is similar in many respects to exercise apparatus 100 with the exception that the foot platforms 140 are pivotally secured to respective left and right foot members 226, 227. Foot platform support members 230 may project outwardly from the lower distal ends of the left and right foot members 226, 227. The foot platform support members 230 may be integrally formed with the left and right foot members 226, 226 or formed separately and fixedly secured to the left and right foot members 226, 226.

The foot platforms 140 may be pivotally secured to the foot platform support members 230 at bearing pins 232 which extend transversely across the foot platform support members 230. Opposite distal end of the bearing pins 232 may pivotally engage with bracket arms 234 fixed to the foot platform support members 230. The foot platforms 140 may be biased upward by a biasing member 236. For example, but without limitation, a compression spring may be disposed between a bottom surface of the foot platforms 140 and the foot platform support members 230. The biasing member 236 may apply an upward force which lifts and rotates the foot platforms 140 about the bearing pins 232 so that the striker boss 146 engages and actuates the trigger switch 148. During downward movement of a foot platform 140, the downward force applied by the user pivots the foot platform 140 about the bearing pin 232, thereby disengaging the striker boss 146 from the trigger switch 148 and compresses the biasing member 236 against the foot platform support member 230. As a user lifts a foot off the foot platform 140, the upward force applied by the biasing member 236 pivots the foot platform 140 about the bearing pin 232 moving the striker boss 146 to engage and actuate the trigger switch 148.

Foot platforms 431 may be free to move fore and aft relative to foot longitudinal members 430 while in rolling contact with a pair of platform rollers 433, where the platform rollers 433 may be rotatably secured to foot longitudinal members 430 at roller yokes 432 fixed to the foot longitudinal members 430 in spaced relationship to one another. Weight sensors 450 may be secured to foot platforms 431 at corner regions thereof, and foot platform plates 420 may contact the upper surfaces of weight sensors 450 in a manner which allows the total weight applied to the foot platform plates 420 to be measured. In order to measure longitudinal forces, foot longitudinal member stanchion 436 may be rigidly secured to foot longitudinal member 430, and vertically orientated flex plate 455 may be bolted to foot longitudinal member stanchion 436 and also secured to foot platform 431 such that strain sensor 459 may change resistance as longitudinal forces are exerted against foot platform 420 causing flex plate 455 (and strain sensor 459) to bend. A pattern of unsymmetrical targets 449 read or sensed by proximate sensor 448 (magnetic or optical) allows meaningful prompting by lights, sound, or vibration regardless of the crank rotation direction.

Figure 5:
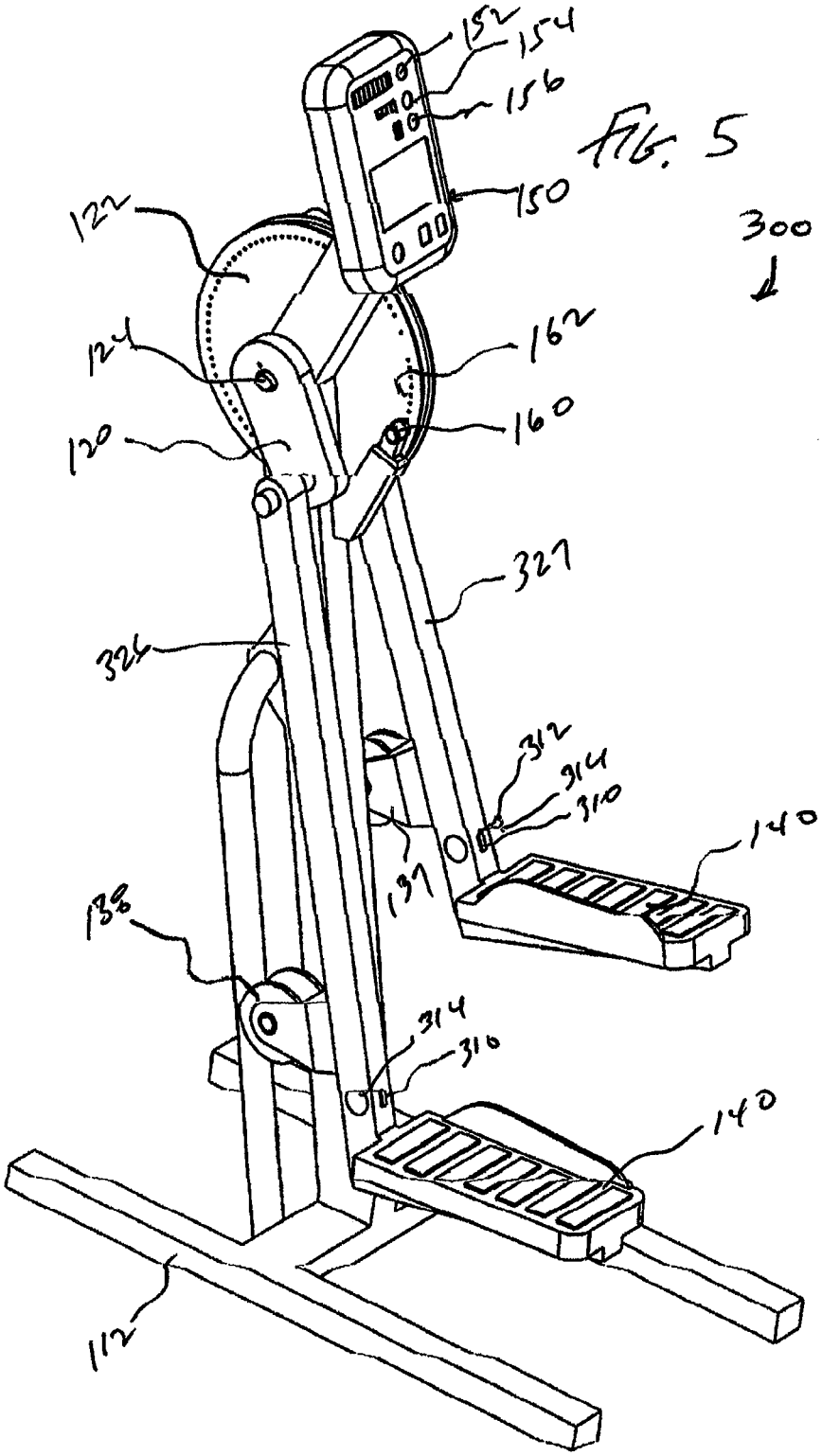
FIG. 5 is a perspective view of a third embodiment of an exercise apparatus.
Figure 6:
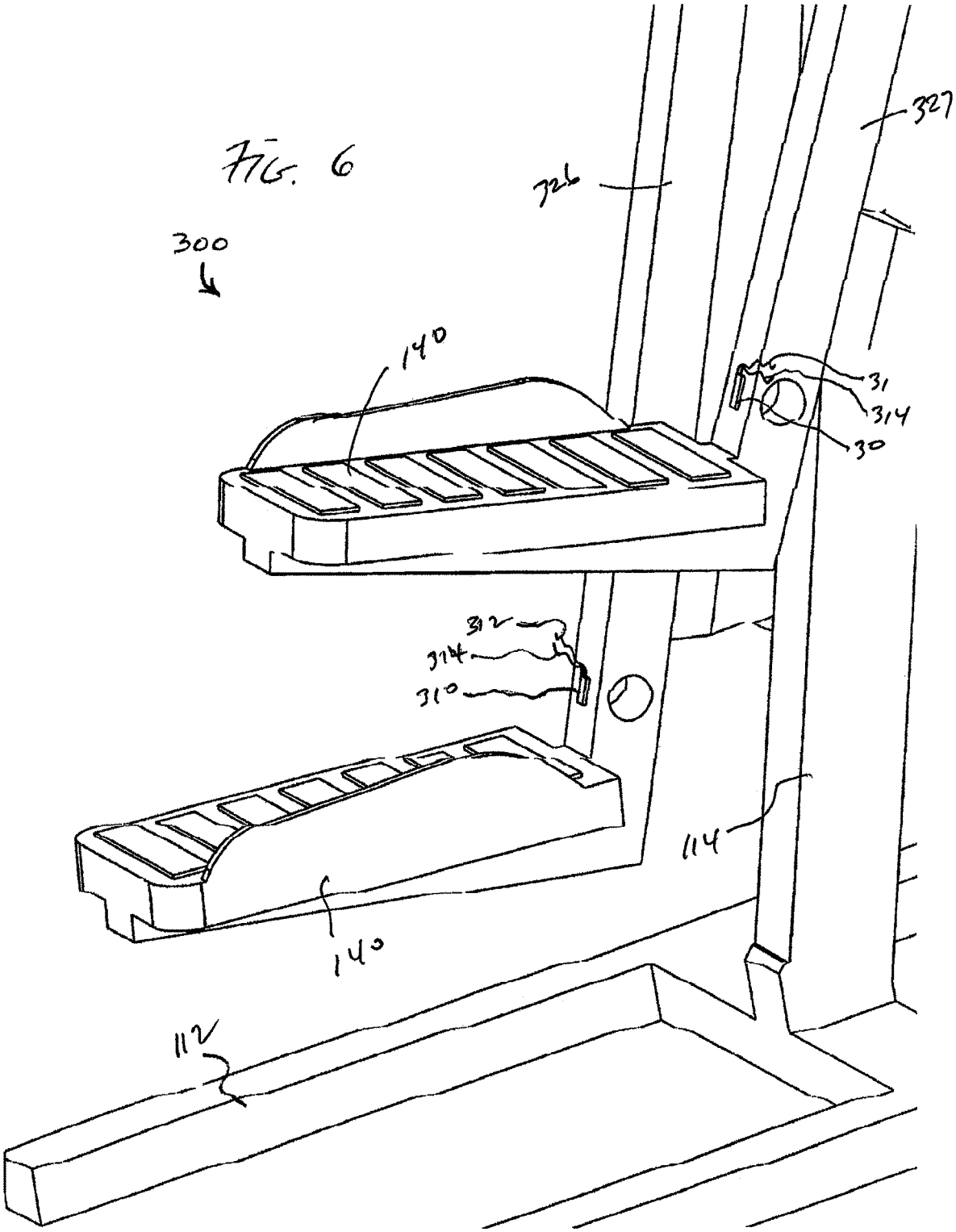
FIG. 6 is a partial fragmented perspective view of the exercise apparatus shown in FIG. 5.

A third embodiment of an exercise apparatus generally identified by the reference numeral 300 is shown in FIGS. 5 and 6. As noted by the use of common reference numerals, the exercise apparatus 300 is similar in many respects to exercise apparatus 100 with the exception that a strain sensor 310 measures the forces experienced at the foot platforms 140. The strain sensor 310 may be installed on the left and right foot members 326, 327 on a lower distal region proximate the foot platforms 140. Electrical leads 312, 314 may provide a means for communicating measured data to the display 150.

Strain sensors 310 enable force proportions experienced at the foot platforms 140 to be measured, as compared to a binary indication when simple switches are utilized. In this instance, absolute numerical values may be displayed or percentages of weight applied to the foot platforms 140 may be displayed on a somewhat arbitrary scale, such as bar graphs and the like. Again, the purpose of such displayed information is to train the user to reduce weight on the foot platform 140 moving up while applying full body weight with the leg of the user (full weight leg press) on the foot platform 140 which is moving down while performing leg pressing stepping motions. In addition to displaying the forces, or a graphical representation of such forces, strain sensors 310 may alternatively enable the use of colored lights which represent the magnitude of such forces, where for example, but without limitation, green may be displayed if the user is exercising correctly with maximum calorie burn, yellow may indicate moderate exercise, and red may indicate that the user needs to exert significantly more leg lifting action in order to maximize calorie burn. Generally, hardwired sensors and the like may be employed, however, wireless embodiments may alternatively be utilized, where for example a change in resistance of a weight or strain sensor may generate a blue tooth signal to a controller which in turn activates a given user prompt.

Figure 7:
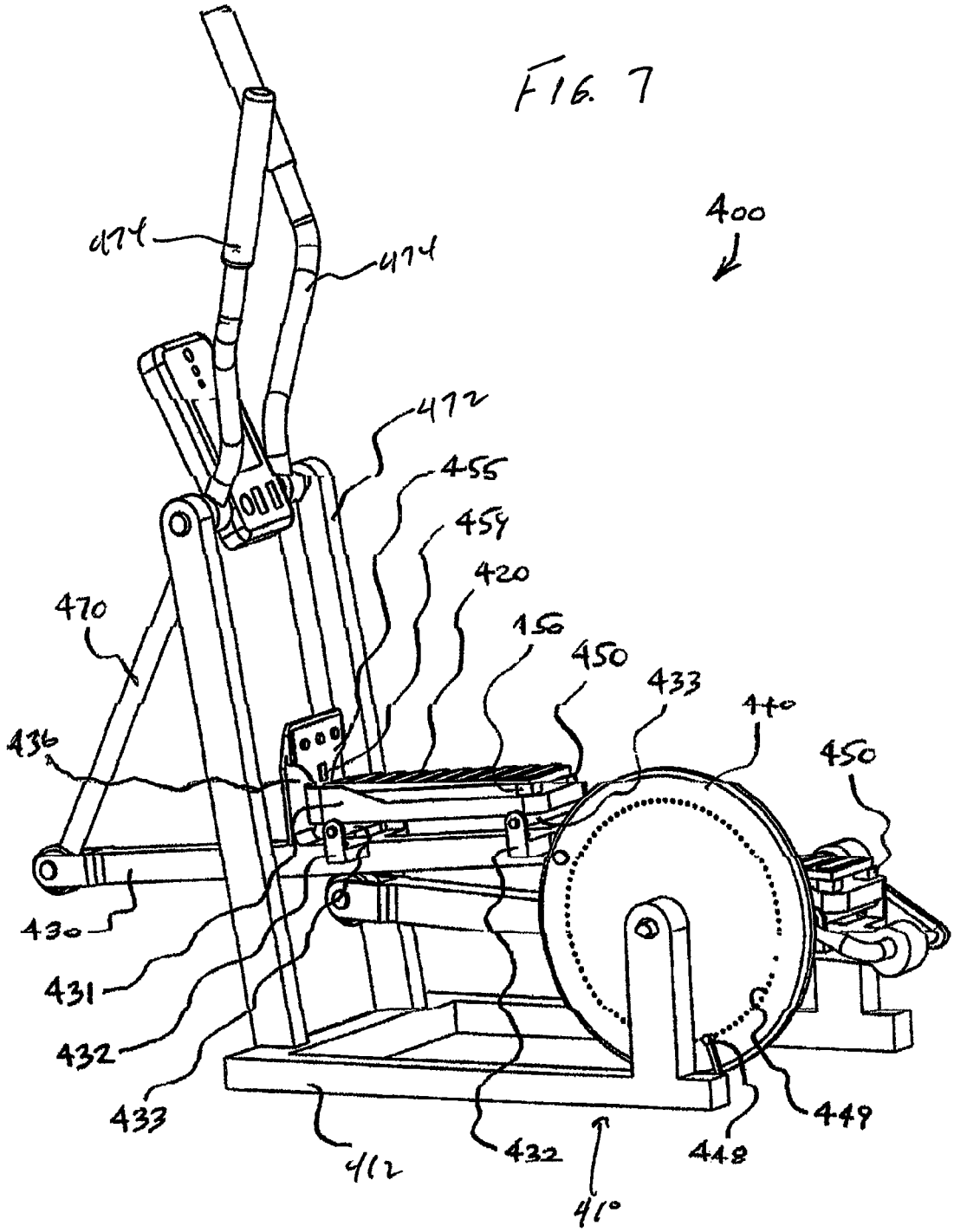
FIG. 7 is a perspective view of a fourth embodiment of an exercise apparatus.

Referring now to FIG. 7, a fourth embodiment of an exercise apparatus is generally identified by the reference numeral 400. The exercise machine 400 may be configured as an elliptical striding machine which may include sensors to measure the weight applied to each foot platform 420, as well as forces applied in longitudinal directions. Crank 440 may be rotatably secured to the base 412 of the machine frame 410. A rear distal end of foot longitudinal members 430 may be rotatably connected to crank 440, and a forward distal end of the foot longitudinal members 430 may be rotatably connected to a lower distal end of front rockers 470. The front rockers 470 may be rotatably secured to front stanchions 472 which extend upward from the base 412 of the frame 410. Handlebars 474 may be rigidly connected to the front rockers 470.

Foot platforms 431 may be free to move fore and aft relative to foot longitudinal members 430 while in rolling contact with a pair of platform rollers 433, where the platform rollers 433 may be rotatably secured to foot longitudinal members 430 at roller yokes 432 fixed to the foot longitudinal members 430 in spaced relationship to one another. Weight sensors 450 may be secured to foot platforms 431 at corner regions thereof, and foot platform plates 420 may contact the upper surfaces of weight sensors 450 in a manner which allows the total weight applied to the foot platform plates 420 to be measured. In order to measure longitudinal forces, foot longitudinal member stanchion 439 may be rigidly secured to foot longitudinal member 430, and vertically orientated flex plate 455 may be bolted to foot longitudinal member stanchion 439 and also secured to foot platform 431 such that strain sensor 459 may change resistance as longitudinal forces are exerted against foot platform 420 causing flex plate 455 (and strain sensor 459) to bend. A pattern of unsymmetrical targets 449 read or sensed by proximate sensor 448 (magnetic or optical) allows meaningful prompting by lights, sound, or vibration regardless of the crank rotation direction.

During use, if the user does not reduce the weight applied to the foot platform 420 while the user's foot is returning forward then a prompting will occur. In order to provide further information as to the aerobic exercise experience, longitudinal force at the foot platform 420 may also be measured, and the user may be encouraged to apply longitudinal forces in a forward direction while the foot platform 420 is moving forward and/or to also apply longitudinal forces in a rearward direction while the toot platform 420 is moving rearward.

Figures 8A, 8B:
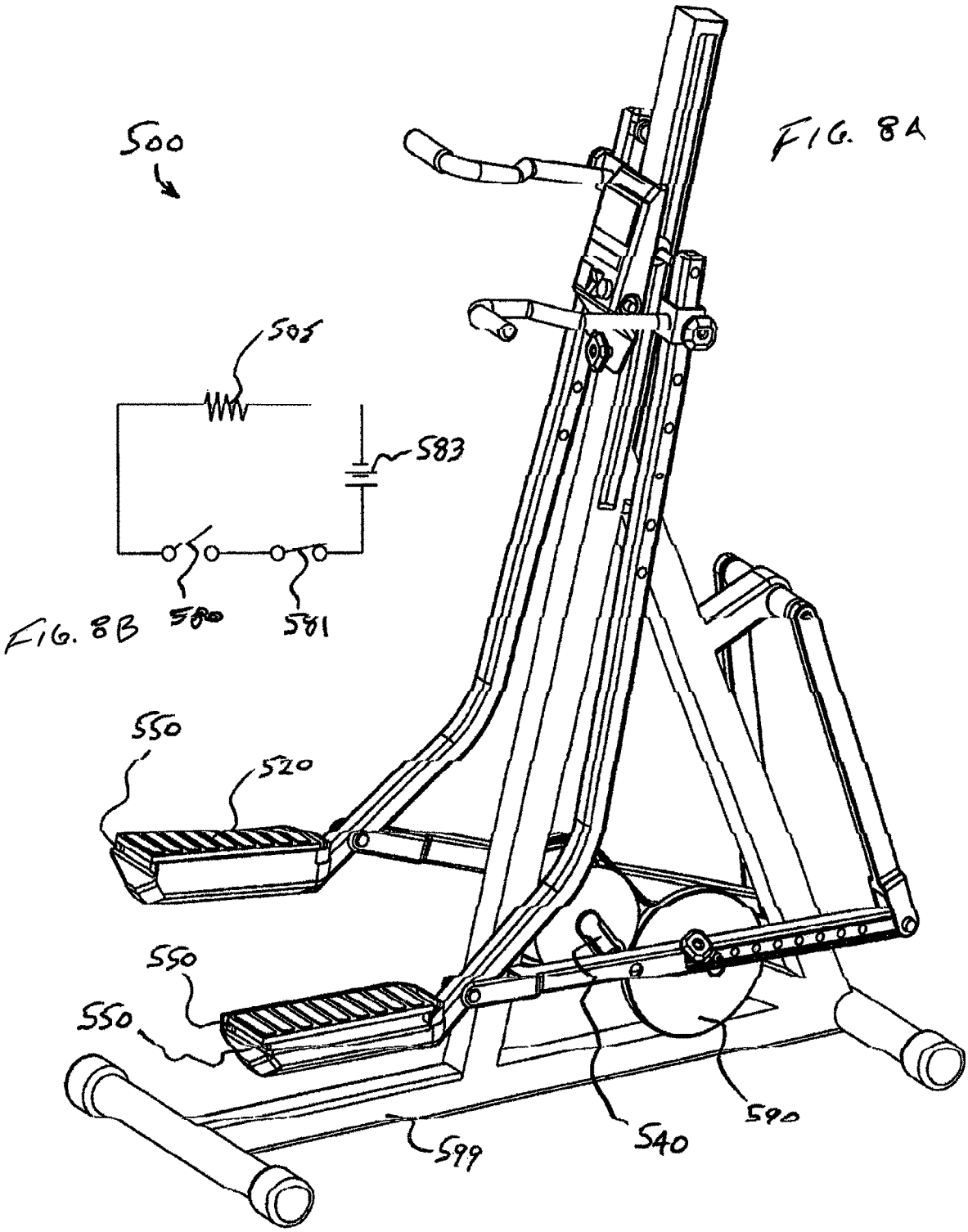
FIG. 8A is a perspective view of a fifth embodiment of an exercise apparatus.
FIG. 8B is a circuit diagram of trigger switches for actuating visual/audio indicators.

Referring now to FIG. 8, a fifth embodiment of an exercise apparatus is generally identified by the reference numeral 500. The exercise apparatus 500 may include switches to only use while determining whether weight is being applied to each of the foot platforms. One or more switches 550 (or left foot platform 520 switch 580, and right foot platform 520 switch 581, depicted in the circuit diagram of FIG. 8B) may be positioned under each foot platform 520, where foot platforms 520 may be connected to a foot member, and where a connector member is rotatably secured to crank 540 to cause a flywheel to rotate in a manner known in the art. User prompting may occur if the user does not open one of two normally closed switches 580/581 (see circuit diagram of FIG. 8A) associated with the foot platforms 520. For example, if the user does not reduce weight on a given foot platform 520 while the foot platform 520 is moving up, then switch 550 remains closed thereby sending power to a resistance element 585 such that illumination or a light on a display panel may occur. As long as the user reduces weight on either of the foot platforms 520 while one or the other foot platform 520 is moving up, then the user would generally be able to prevent such prompting to occur. It is recognized that during normal operation there may be relatively brief moments when both switches 580 and 581 may be closed, but timers and the like may be employed within the switch circuit to delay prompting until after such moments have passed.

Figure 9:
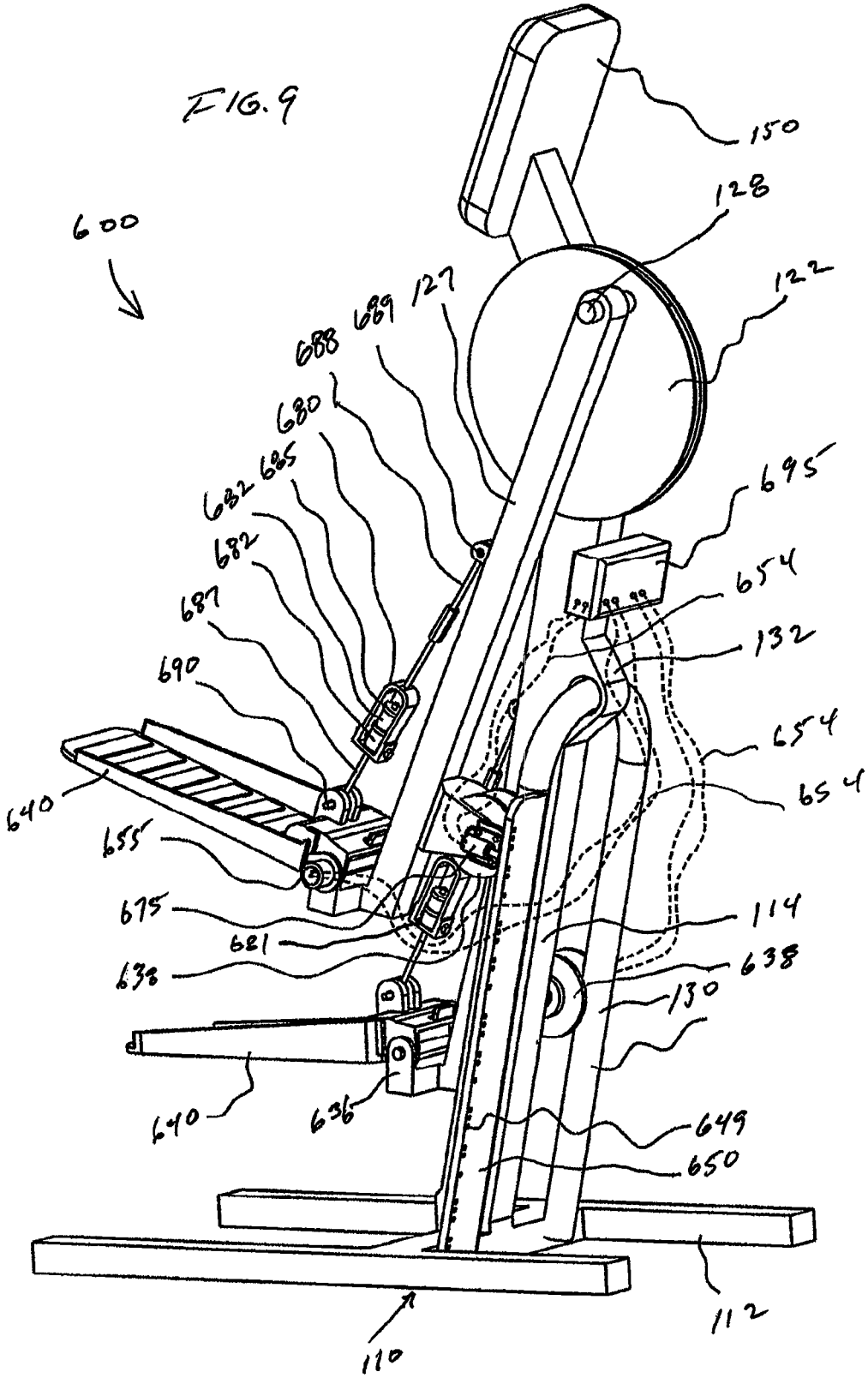
FIG. 9 is a perspective view of a sixth embodiment of an exercise apparatus.
Figure 10:
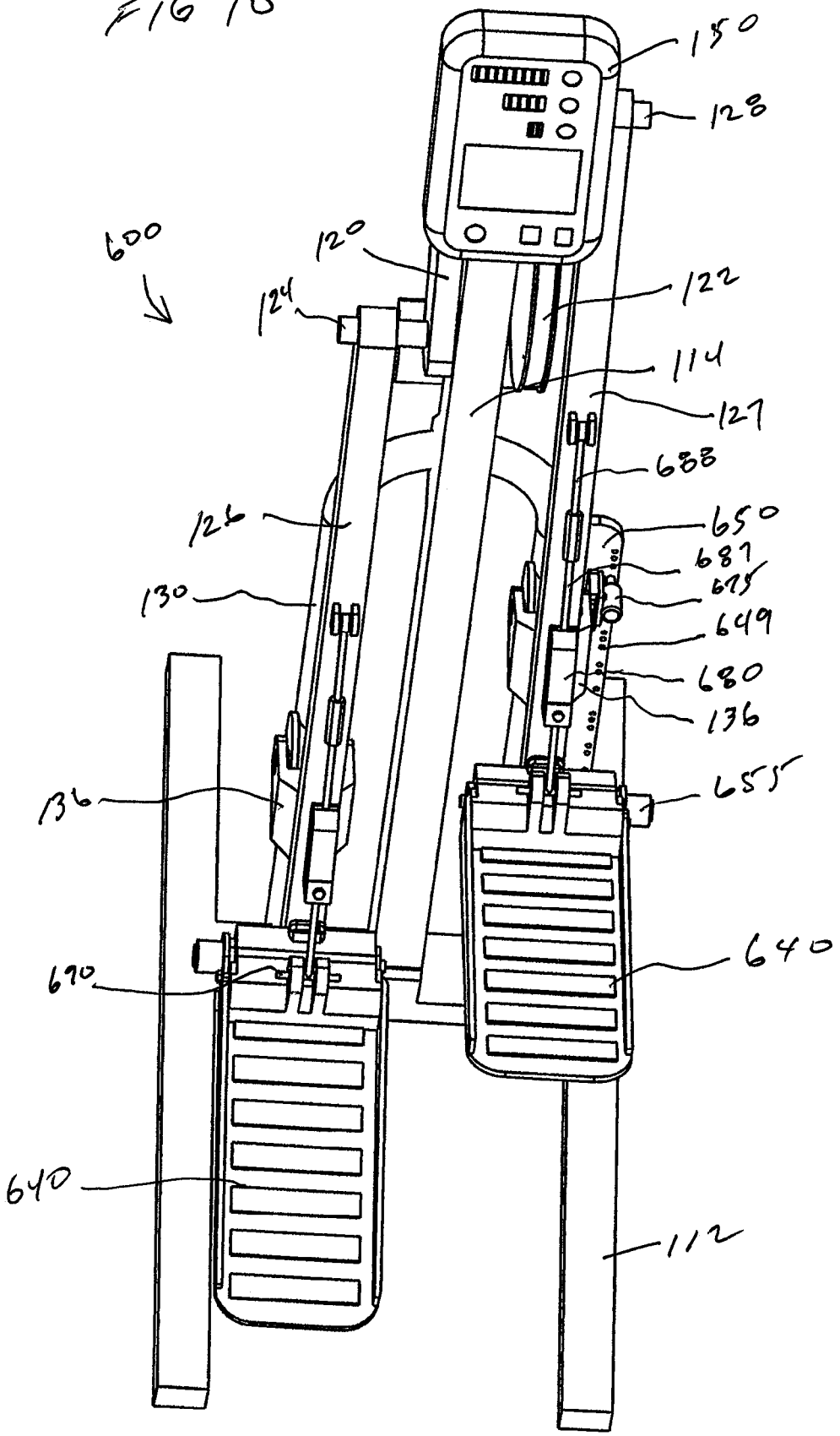
FIG. 10 is a rear perspective view of the exercise apparatus shown in FIG. 9.
Figure 11:
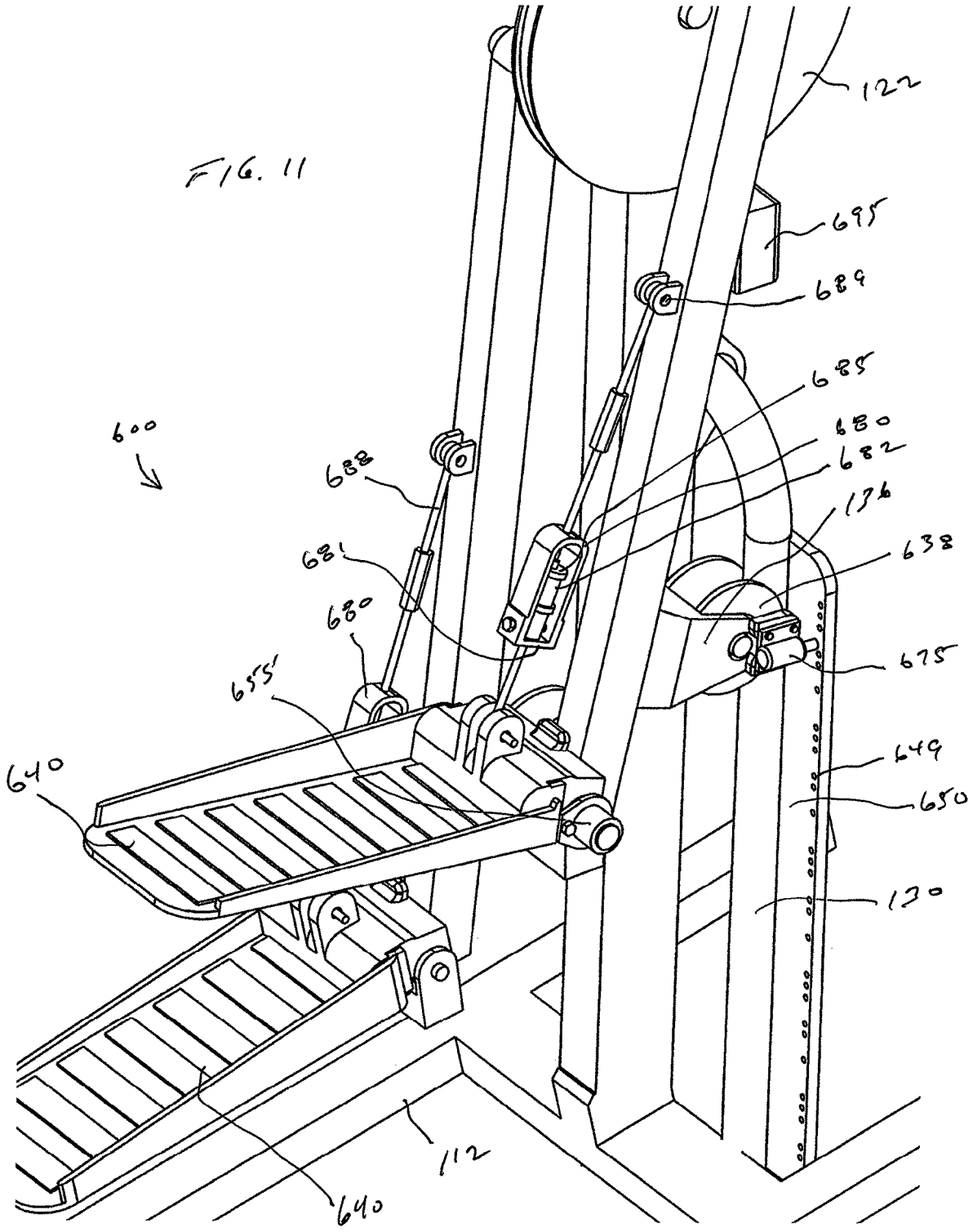
FIG. 11 is a partial fragmented perspective of the exercise apparatus shown in FIG. 9.

Referring now to FIGS. 9-11, a sixth embodiment of an exercise apparatus is generally identified by the reference numeral 600. As noted by the use of common reference numerals, the exercise apparatus 600 is similar in many respects to exercise apparatus 100. The exercise apparatus 600 may include a frame 110 configured to rest on a substantially flat surface. The frame 110 may include a base 112 and a stanchion 114 extending upwardly from the base 112.

A left crank 120 and a right crank 122 may be rotatably secured to opposite sides of the stanchion 114 at crank shaft 124 (shown in FIG. 1). The left crank 120 and right crank 122 may be keyed to the crank shaft 124 so that they rotate together. A left foot member 126 may be rotatably connected to the crank shaft 120 at pivot shaft 128. A right foot member 127 may be rotatably connected to the right crank 122 at a pivot shaft 129.

Left and right frame members 130 may extend generally vertically from the base 112. The upper distal ends of the frame members 130 may connect to the stanchion 114 at a node or projection 132 located at an intermediate point 132 between the distal ends of the stanchion 114. The frame members 130 may be spaced apart and located on either side of the stanchion 114 and may define a generally vertical plane substantially parallel to the longitudinal axis of the stanchion 114.

Roller brackets 636, 637 may secure rollers 638 to intermediate regions of the left and right foot members 126, 127, respectively. The rollers 638 may be in rolling contact with respective frame members 130. During operation of the exercise apparatus 600, the rollers 638 may roll along the frame members 130 during the up and down movement of the foot platforms 640.

The exercise apparatus 600 may include an optical or inductive foot member sensor 675 mounted to the roller bracket 637 for reading an unsymmetrical pattern of targets 649 on a generally vertical plate 650 fixedly secured to a frame member 130. One foot member sensor 675 is sufficient to provide relevant data presented on the display 150. If it is known that one foot member 126, 127 is moving downward, then it is known that the other foot member 126, 127 is moving upward. In addition, from the known direction of movement of the foot members 126,127, the position of a first roller 638 along a first frame member 130 may be known from data provided by the foot member sensor 675, the position of a second roller 638 may be determined relative to a second frame member 130. In similar manner, a single sensor 675 may be installed at other locations proximate the foot members 130 or foot platforms 640 to determine whether a given foot platform is moving up or down and then correlate that information with a foot platform potentiometer 655 (or strain sensor 450) which may generate a signal displayed on the display 150 to encourage the user to lift his foot from the upwardly moving foot platform 640 to maximize caloric burn as described in greater detail hereinabove. Electrical leads 654 may provide a means for communicating measured data from the potentiometer 655 and sensor 675 to a display interface module 695.

The foot platforms 640 may be biased upward relative to the foot members 126, 127 by urethane compression springs 682 housed within a spring cage 680. An upper disk 685 may be rigidly secured to a distal end of a rod 687 extending through the urethane compression spring 682. The opposite distal end of the rod 687 may be pivotally secured to the foot platform 640 at journal bearing 690. A lower end of a rod 688 may be fixedly connected to the spring cage 680 and the opposite end of the rod 688 may be pivotally connected to a respective foot member 126, 127 at journal bearing 689. The urethane compression springs 682 may be captured between the disk 685 and a lower wall 681 of the spring cage 680. As a downward force is applied to the foot platforms 640, the urethane springs 682 are compressed. When the downward force is removed by lifting the user's foot, the upward biasing force of the urethane spring 682 rotated the foot platforms 640 upward and thereby actuating the trigger switch 148.

Those skilled in the art will recognize that sensors for determining the direction of movement and position of the foot members 126, 127 may be omitted. A logic circuit may be utilized to determine how a user is interaction with the foot platforms 640 along the foot path. For example, but without limitation, a simple "OR" circuit may be employed, where such a circuit may compare weight force applied to the foot platforms 640, and/or the ratio of the weight force on each foot platform 640. It may be assumed that most or all of the weight of the user is applied to the downward moving platform 640, so any weight on the upward moving foot platform 640 would indicate the degree to which a user has lifted his foot off of the upward moving foot platform 640. In such a configuration, use of strain sensors may provide sufficient information to encourage the user to lift his foot off the upward moving foot platform 640 with the object to maximize calorie burn.

In any of the embodiments described above, instantaneous information readouts may be displayed on the display 150, or averages of information over a given period of time may be displayed. For example, in the latter case a bar graph indicating the magnitude of "unweighing" or foot lifting activity over a period of time may be displayed, or similarly and analog needle on the display 150 may be provided where the orientation of the needle indicates the magnitude of "unweighing" or foot lifting activity over a period of time.

While preferred embodiments of an exercise apparatus been shown and described, other and further embodiments may be devised without departing from the basic scope thereof, and the scope thereof is determined by the claims which follow.

The invention claimed is:

1. An exercise apparatus, comprising:

a) a frame configured to rest on a floor surface, said frame including a base;

b) a left foot member and a right foot member, wherein said left foot member and said right foot member are rotatably connected to a stanchion, said stanchion extending upward from said base;

c) a left frame member and a right frame member extending generally vertically from said base, each said frame member including an upper distal end connected to said stanchion;

d) a left foot platform and a right foot platform secured to a lower end of a respective said left and right foot member;

e) a toe plate pivotally connected to a respective said left and right foot platform; and f) a striker boss secured to said toe plate in spaced facing relationship with a trigger switch secured to a respective said left and right foot member.

2. The exercise apparatus of claim 1 including a crank rotatably secured on opposite sides of said stanchion, wherein said left foot member and said right foot member are rotatably connected to a respective said crank.

3. The exercise apparatus of claim 1 including a roller mounted proximate a lower end of a respective said left foot member and said right foot member, wherein said left foot member and said right foot member are in rolling contact with a respective said left frame member and said right frame member.

4. The exercise apparatus of claim 2 including a sensor mounted on said stanchion, a respective said crank including target indicia readable by said sensor.

* * * * *